US011072952B2

(12) United States Patent
Elkasevic

(10) Patent No.: US 11,072,952 B2
(45) Date of Patent: Jul. 27, 2021

(54) SIDE OPENING DOOR KEEPER

(71) Applicants: BSH Home Appliances Corporation, Irvine, CA (US); BSH Hausgeräte GmbH, Munich (DE)

(72) Inventor: Suad Elkasevic, Winterville, NC (US)

(73) Assignees: BSH Home Appliances Corporation, Irvine, CA (US); BSH Hausgerate GmbH, Munich (DE)

( * ) Notice: Subject to any disclaimer, the term of this patent is extended or adjusted under 35 U.S.C. 154(b) by 0 days.

(21) Appl. No.: 16/293,988

(22) Filed: Mar. 6, 2019

(65) Prior Publication Data

US 2020/0284076 A1 Sep. 10, 2020

(51) Int. Cl.
*E05D 3/00* (2006.01)
*E05C 17/20* (2006.01)
*E05D 3/18* (2006.01)

(52) U.S. Cl.
CPC ..... *E05C 17/203* (2013.01); *E05D 3/18* (2013.01)

(58) Field of Classification Search
CPC ..... E05C 17/203; E05D 3/18
See application file for complete search history.

(56) References Cited

U.S. PATENT DOCUMENTS 255,781 A * 4/1882 Graeser ..... A47C 17/44 5/314.1
529,171 A * 11/1894 Hegenscheidt ..... E05D 11/1007 16/348
1,555,781 A * 9/1925 Amsden ..... A47B 41/02 16/322
1,703,969 A * 3/1929 Fosshage ..... B60N 2/3011 16/357
1,707,511 A * 4/1929 Cornwell ..... A45C 13/34 217/60 D
1,772,559 A * 8/1930 Soss ..... E05D 3/14 16/357
2,233,882 A * 3/1941 Bobek ..... E05C 17/38 16/348
2,623,767 A * 12/1952 Persson ..... E05D 7/086 292/38
2,873,470 A * 2/1959 De Dona ..... E05C 17/16 16/333

(Continued)

FOREIGN PATENT DOCUMENTS

JP H02285184 A 11/1990
JP H0444583 A 2/1992

*Primary Examiner* — Jason W San
(74) *Attorney, Agent, or Firm* — Michael E. Tschupp; Andre Pallapies; Brandon G. Braun

(57) ABSTRACT

A door keeper, for keeping a door opening angle of a door within a predetermined angle, includes a hinge bracket attached to a support structure; a keeper plate having a bracket side end portion pivotally mounted to the hinge bracket, a door side end portion, and a keeper guide slot having a door side slot end portion disposed proximate to the door side end portion of the keeper plate, the keeper guide slot extending from the door side slot end portion to an opposite slot end portion disposed at a location between the bracket side end portion and the door side end portion of the keeper plate; and a keeper member movably disposed in the keeper guide slot and fixedly attached to a lower part of the door. An opening motion of the door stops when the door side slot end portion engages the keeper member.

13 Claims, 6 Drawing Sheets

(56) References Cited

U.S. PATENT DOCUMENTS 3,067,736 A * 12/1962 Barefoot ..... F24C 15/023 126/194
3,359,028 A * 12/1967 Seckerson ..... E05C 17/085 292/263
4,068,348 A * 1/1978 Chivers ..... E05D 3/12 16/235
4,163,443 A * 8/1979 Peterson ..... E05C 5/00 126/197
4,218,092 A * 8/1980 Schach ..... B60N 2/2352 297/367 R
4,312,078 A * 1/1982 Pollitt ..... A42B 3/222 16/348
4,621,864 A * 11/1986 Hill ..... B60N 2/242 297/115
4,738,003 A * 4/1988 Mori ..... E05D 3/127 16/321
4,788,746 A * 12/1988 Idler ..... B64G 1/222 16/297
4,848,873 A * 7/1989 Villar ..... B61K 9/06 359/230
4,953,259 A * 9/1990 Frye ..... E05D 11/06 16/225
5,274,902 A * 1/1994 Rowley ..... B25H 7/00 144/329
5,394,590 A * 3/1995 Yu ..... A47J 37/0786 126/25 R
5,414,898 A * 5/1995 Gastaldi ..... A45C 13/34 16/345
5,465,557 A * 11/1995 Harte ..... B65B 31/02 16/289
5,549,051 A * 8/1996 Zimmerman ..... A47B 1/04 108/80
5,931,554 A * 8/1999 Koopman ..... E05F 1/1253 16/286
6,493,906 B2 * 12/2002 Matteau ..... E05D 3/18 16/358
6,945,621 B2 * 9/2005 Shin ..... E05D 3/18 16/359
6,948,758 B2 * 9/2005 Henderson ..... B60J 7/141 16/357
7,065,835 B2 * 6/2006 Kuramochi ..... G06F 1/1616 16/348
7,360,278 B2 * 4/2008 Jang ..... E05F 1/1016 16/348
7,596,831 B2 * 10/2009 Faubert ..... E05D 3/18 16/287
7,712,627 B2 * 5/2010 Yang ..... G11B 33/022 220/830
7,895,998 B2 * 3/2011 Lee ..... F24C 15/022 126/197
7,934,293 B2 * 5/2011 Kalargeros ..... B60R 21/38 16/369
8,108,971 B2 * 2/2012 Florek ..... E05F 1/1276 16/357
8,201,304 B2 * 6/2012 Steurer ..... E05F 1/1261 16/286
8,201,306 B2 * 6/2012 Kim ..... E05F 1/1215 16/360
8,303,059 B2 * 11/2012 Darney ..... E05D 3/18 312/405
8,468,655 B2 * 6/2013 Borkgren ..... A01B 73/044 16/348
8,713,758 B2 * 5/2014 Mitsui ..... H04M 1/0237 16/357
9,004,212 B2 * 4/2015 Noda ..... E02F 9/0891 180/69.21
2003/0172920 A1 * 9/2003 Gronbach ..... F24C 15/023 126/197
2005/0132535 A1 * 6/2005 Jang ..... F25D 23/02 16/357
2006/0032019 A1 * 2/2006 Kistner ..... E05D 7/12 16/286
2007/0193572 A1 * 8/2007 Lee ..... E05D 7/12 126/194
2007/0209654 A1 * 9/2007 Wang ..... F24C 15/023 126/194
2007/0234520 A1 * 10/2007 Faubert ..... E05D 11/1071 16/357
2012/0017395 A1 * 1/2012 Huachun ..... A47C 17/162 16/382
2012/0017398 A1 * 1/2012 Huachun ..... A47C 1/026 16/386
2012/0060323 A1 * 3/2012 Lee ..... E05D 15/582 16/275
2013/0312221 A1 * 11/2013 Elkasevic ..... E05F 1/1261 16/327

* cited by examiner

SIDE OPENING DOOR KEEPER

FIELD OF THE INVENTION

The present disclosure relates to a door keeper for keeping a door opening angle of a door within a predetermined angle and, more particularly, to a side opening door keeper for home appliances such as built-in appliances having side opening doors.

BACKGROUND OF THE INVENTION

In general, when opening a door it is preferable to have some kind of stop to prevent the door from accidentally swinging uncontrollably and striking a wall, a piece of furniture, and the like and causing damage to the door and/or the wall or furniture.

SUMMARY OF THE INVENTION

An apparatus consistent with the present disclosure is directed to a door keeper to prevent a door from over-travelling and accidentally colliding with a wall, a piece of furniture, and the like and causing damage to the door and/or the wall or furniture.

An apparatus consistent with the present disclosure is directed to a door keeper for keeping a door opening angle of a door within a predetermined angle and, more particularly, to a door keeper for home appliances such as built-in appliances having side opening doors.

An apparatus consistent with the present disclosure is directed to a side opening door keeper for a home appliance such as a side opening door for a built-in oven.

An apparatus consistent with the present disclosure is directed to a side opening door keeper for a built-in oven where the side opening oven door is permitted to open to a maximum opening angle of 130°±5°.

An apparatus consistent with the present disclosure provides a door keeper having a keeper plate with a keeper guide slot that is shaped so as to permit the keeper plate to glide in the roller groove of a keeper member and such that the keeper guide slot is completely concealed in a working range of 0° to 130°±5°.

An apparatus consistent with the present disclosure provides a door keeper having a keeper plate with a keeper guide slot that is shaped to include an oversized hole at one end so that a keeper member such as a flanged keeper bearing roller can be inserted during assembly and removed for servicing of the door keeper.

According to one aspect, the present disclosure provides a door keeper for keeping a door opening angle of a door within a predetermined angle, including a hinge bracket configured to be attached to a support structure; a keeper plate having a bracket side end portion pivotally mounted to the hinge bracket, a door side end portion, and a keeper guide slot having a door side slot end portion disposed proximate to the door side end portion of the keeper plate, the keeper guide slot extending from the door side slot end portion to an opposite slot end portion disposed at a location between the bracket side end portion and the door side end portion of the keeper plate; and a keeper member movably disposed in the keeper guide slot and fixedly attached to a lower part of the door. An opening motion of the door stops when the door side slot end portion of the keeper guide slot engages the keeper member.

According to another aspect, the keeper member comprises a flanged keeper bearing roller which defines a roller groove which is configured to permit the keeper plate to glide in the roller groove during the opening motion of the door.

According to another aspect, the flanged keeper bearing roller comprises an upper flange that is configured to slide over an upper face of the keeper plate and a lower flange that is configured to slide over a lower face of the keeper plate, and a roller bearing body that extends between the upper flange and the lower flange to define the roller groove and is configured to glide with respect to the keeper guide slot.

According to another aspect, the opposite slot end portion of the keeper guide slot comprises an insertion portion having an opening slightly larger than a diameter of the upper and lower flanges in order to permit the flanged keeper bearing roller to be inserted and removed from the keeper guide slot during assembly or servicing.

According to another aspect, the insertion portion extends at an angle from a remaining portion of the keeper guide slot, where the remaining portion has a width similar to a diameter of the roller bearing body to permit a gliding movement of the flanged keeper bearing roller in the keeper guide slot.

According to another aspect, the bracket side end portion of the keeper plate is pivotally mounted to the hinge bracket via a rivet.

According to another aspect, the keeper member is fixedly attached to a bottom portion of the door.

According to another aspect, the keeper member is fixedly attached to the bottom portion of the door via a screw.

According to another aspect, the keeper member is fixedly attached to a door frame bottom portion of the door.

According to another aspect, the keeper guide slot comprises an arcuate portion which extends from the door side slot end portion to a bearing closed door position which is adjacent to the opposite slot end portion.

According to another aspect, the door side slot end portion corresponds to a bearing open door position.

According to another aspect, the opposite slot end portion of the keeper guide slot comprises an insertion portion configured to permit the keeper member to be inserted and removed from the keeper guide slot during assembly or servicing.

According to another aspect, the predetermined angle of the door opening angle is 130°±5°.

According to another aspect, the keeper guide slot is shaped so as to permit the keeper plate to glide in a roller groove of the keeper member and such that the keeper guide slot is completely concealed in a working range of 0° to 130°±5°.

According to another aspect, the present disclosure provides a door keeper in combination with a side-opening oven door for keeping an opening angle of the side-opening oven door within a predetermined angle, the door keeper comprising: a hinge bracket configured to be attached to a body of an oven; a keeper plate having a bracket side end portion pivotally mounted to the hinge bracket, a door side end portion, and a keeper guide slot having a door side slot end portion disposed at a location proximate to the door side end portion of the keeper plate, the keeper guide slot extending from the door side slot end portion to an opposite slot end portion disposed at a location between the bracket side end portion and the door side end portion of the keeper plate; and a keeper member movably disposed in the keeper guide slot and fixedly attached to a lower part of the side-opening oven door, wherein on condition that the door side slot end portion of the keeper guide slot engages the keeper member, an opening motion of the side-opening oven door stops.

According to another aspect, the side-opening oven door is pivotally mounted on at least one hinge shaft.

According to another aspect, on condition that the door side slot end portion of the keeper guide slot engages the keeper member, the keeper plate contacts the at least one hinge shaft.

According to another aspect, the predetermined angle of the opening angle is 130°±5°.

According to another aspect, the keeper member is fixedly attached to a bottom portion of the side-opening oven door.

According to another aspect, the keeper guide slot comprises an arcuate portion which extends from the door side slot end portion to a bearing closed door position which is adjacent to the opposite slot end portion.

According to another aspect, the present disclosure provides a built-in oven having a side-opening oven door, comprising: an oven body defining an oven cavity having an opening that is closable by the side-opening oven door, the side-opening oven door being pivotally mounted to the oven body on at least one hinge shaft; a door keeper for keeping an opening angle of the side-opening oven door within a predetermined angle, the door keeper comprising: a hinge bracket attached to the oven body proximate to the opening; a keeper plate having a bracket side end portion pivotally mounted to the hinge bracket, a door side end portion, and a keeper guide slot having a door side slot end portion disposed at a location proximate to the door side end portion of the keeper plate, the keeper guide slot extending from the door side slot end portion to an opposite slot end portion disposed at a location between the bracket side end portion and the door side end portion of the keeper plate; and a keeper member movably disposed in the keeper guide slot and fixedly attached to a lower part of the side-opening oven door, wherein on condition that the door side slot end portion of the keeper guide slot engages the keeper member, the keeper plate contacts the at least one hinge shaft, and an opening motion of the side-opening oven door stops.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 5:
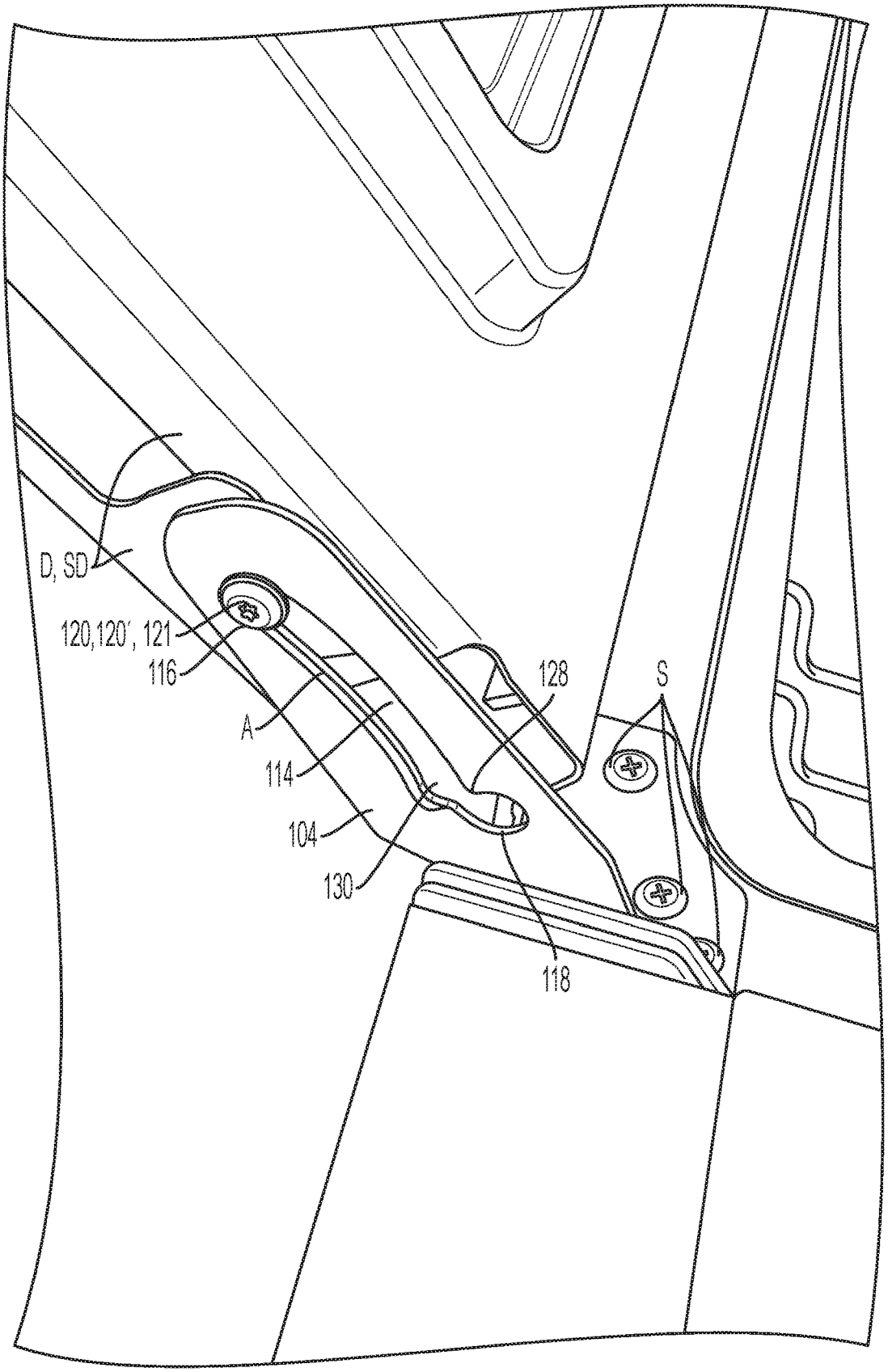
Figure 6:
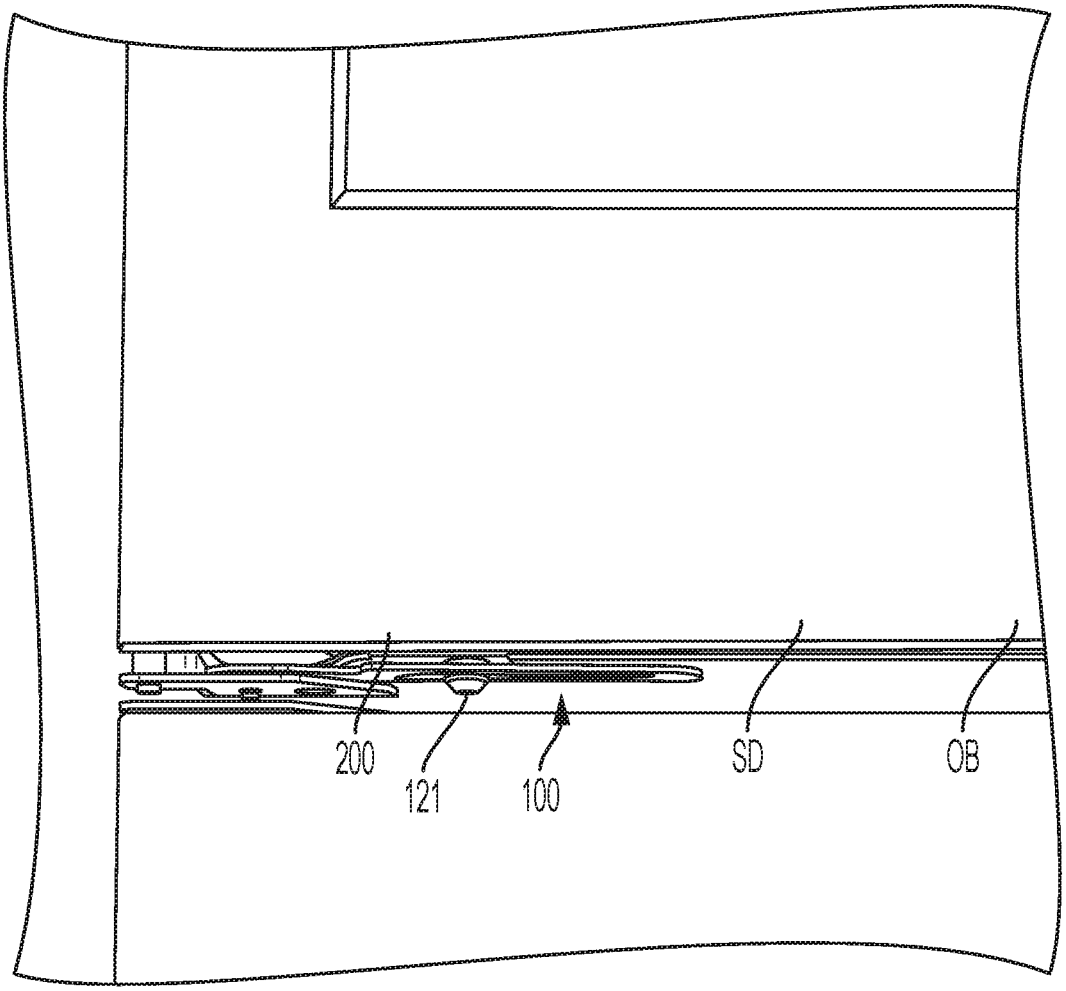

FIG. 5 is a perspective view from below of the door keeper installed on the side-opening oven door of a built-in oven with the side-opening oven door in a fully open position according to an exemplary embodiment consistent with present disclosure; and FIG. 6 is a perspective view from below of the door keeper installed on the side-opening oven door of a built-in oven with the side-opening oven door in a fully closed position according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, rearward, upper, lower, upward, downward, vertical, horizontal and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
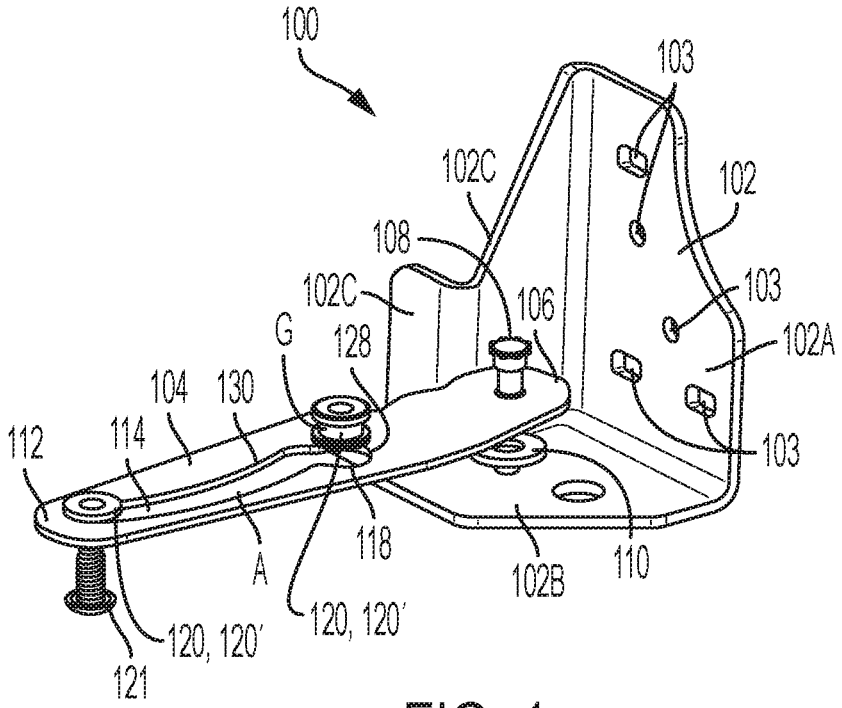
FIG. 1 illustrates an exploded perspective view of a door keeper according to an exemplary embodiment consistent with present disclosure.
Figure 2:
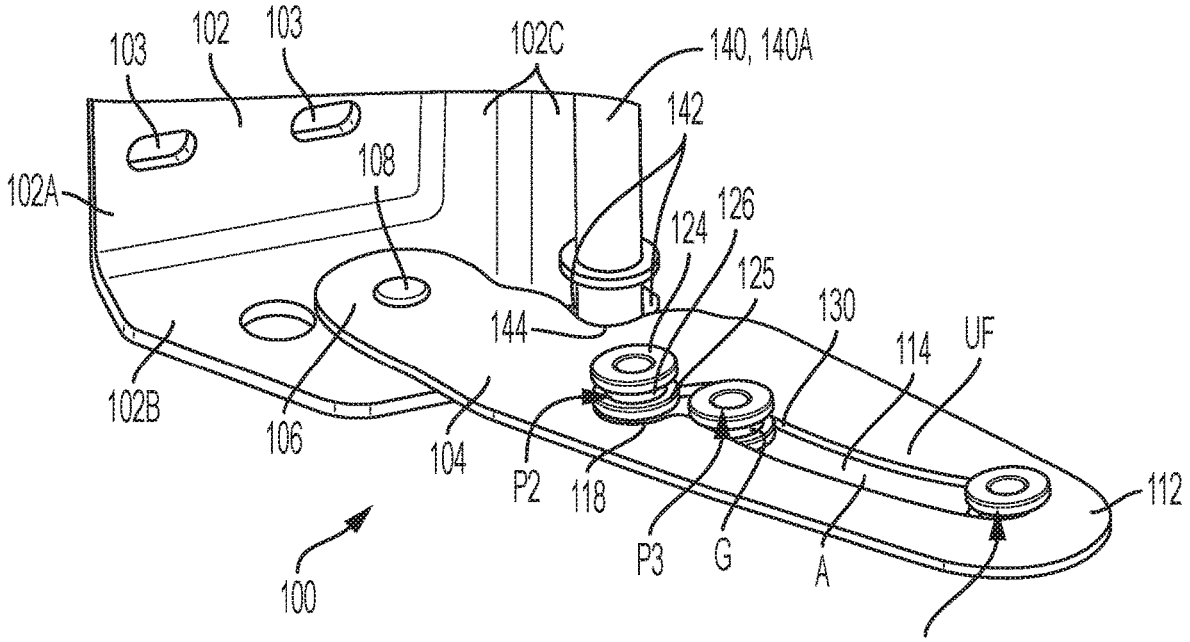
FIG. 2 is an explanatory perspective view of the door keeper according to an exemplary embodiment consistent with present disclosure.

FIG. 1 illustrates an exploded perspective view and FIG. 2 is an explanatory perspective view of a door keeper 100 according to an exemplary embodiment consistent with present disclosure. As will be discussed in more detail, the door keeper 100 is configured to keep a door opening angle of a door within a predetermined angle to prevent a door from over-travelling and accidentally colliding with a wall, a piece of furniture, and the like and causing damage to the door and/or the wall or furniture. As used herein, unless explicitly indicated otherwise in the claims, the term "door" is not limited to just a side-opening oven door for a built-in oven, as the door keeper clearly has applications with respect to doors of other home appliances and for doors in general.

Figure 3:
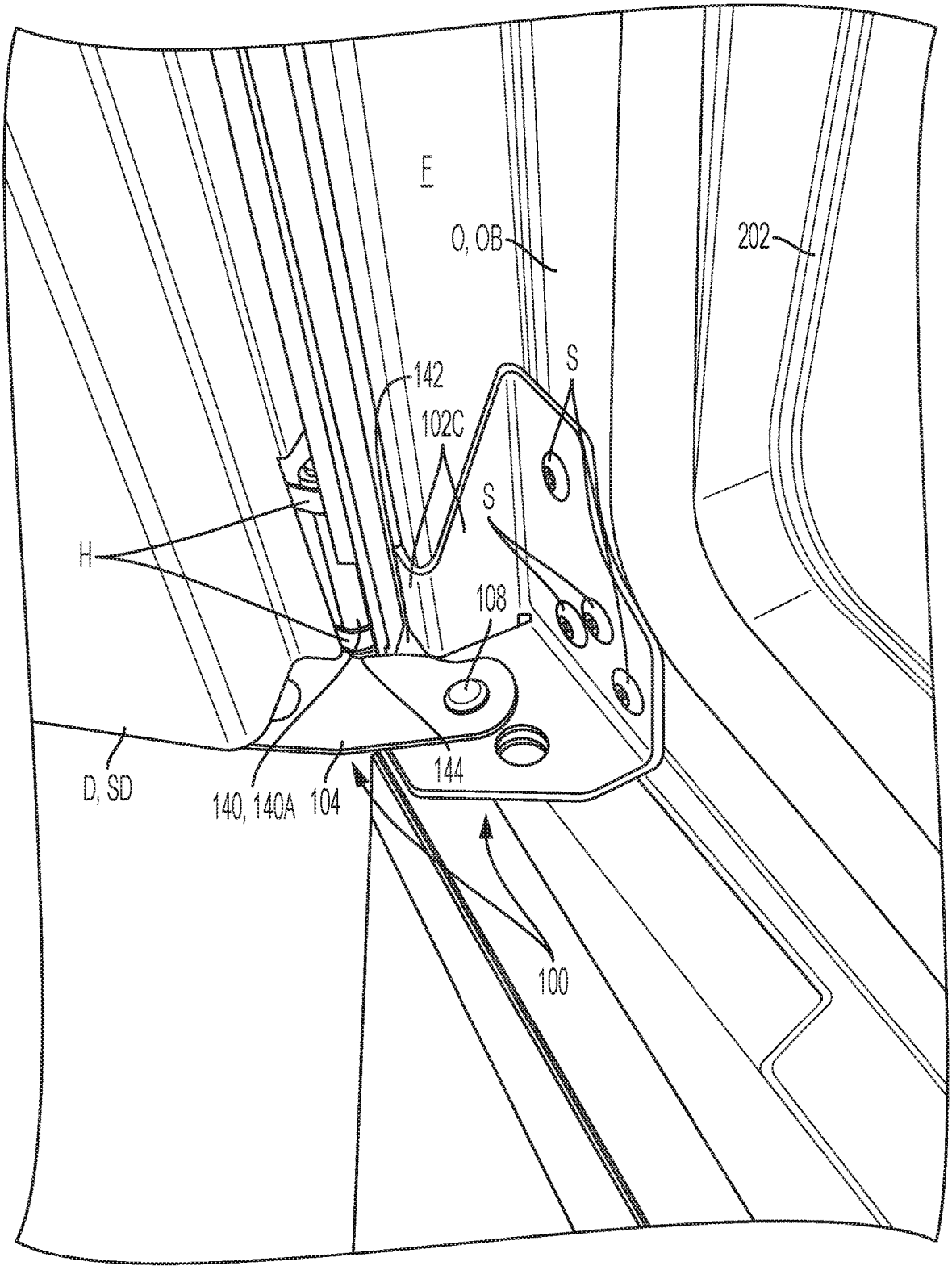
FIG. 3 is a perspective view from above of the door keeper installed on the side-opening oven door of a built-in oven according to an exemplary embodiment consistent with present disclosure.

With reference to FIGS. 1-3, the door keeper 100 includes a hinge bracket 102 attached to a support structure O. In this case, the hinge bracket 102 has a vertical portion 102A with fastener through-holes 103 and that is shown in FIG. 3 as being fixed by suitable fasteners, such as screws S (e.g., thread-forming screws), to a frame portion F of a built-in oven (described below) as the support structure O. The door keeper 100 further includes a keeper plate 104 having a bracket side end portion 106 pivotally mounted to a horizontal portion 102B of the hinge bracket 102 via a rivet 108 (e.g., 1022 CRS type rivet) and a thrust bearing 110 formed of, for example, polytetrafluoroethylene (PTFE), a door side end portion 112, and a keeper guide slot 114 having a door side slot end portion 116 (see FIG. 4) disposed proximate to the door side end portion 112 of the keeper plate 104. The door side slot end portion 116 corresponds to a bearing open door position P1. The keeper guide slot 114 extends from the door side slot end portion 116 to an opposite slot end portion 118 disposed at a location between the bracket side end portion 106 and the door side end portion 112 of the keeper plate 104. The hinge bracket 102 further includes a wrap-around portion 102C that wraps around the frame portion F of the built-in oven (see FIGS. 1-3).

Figure 4:
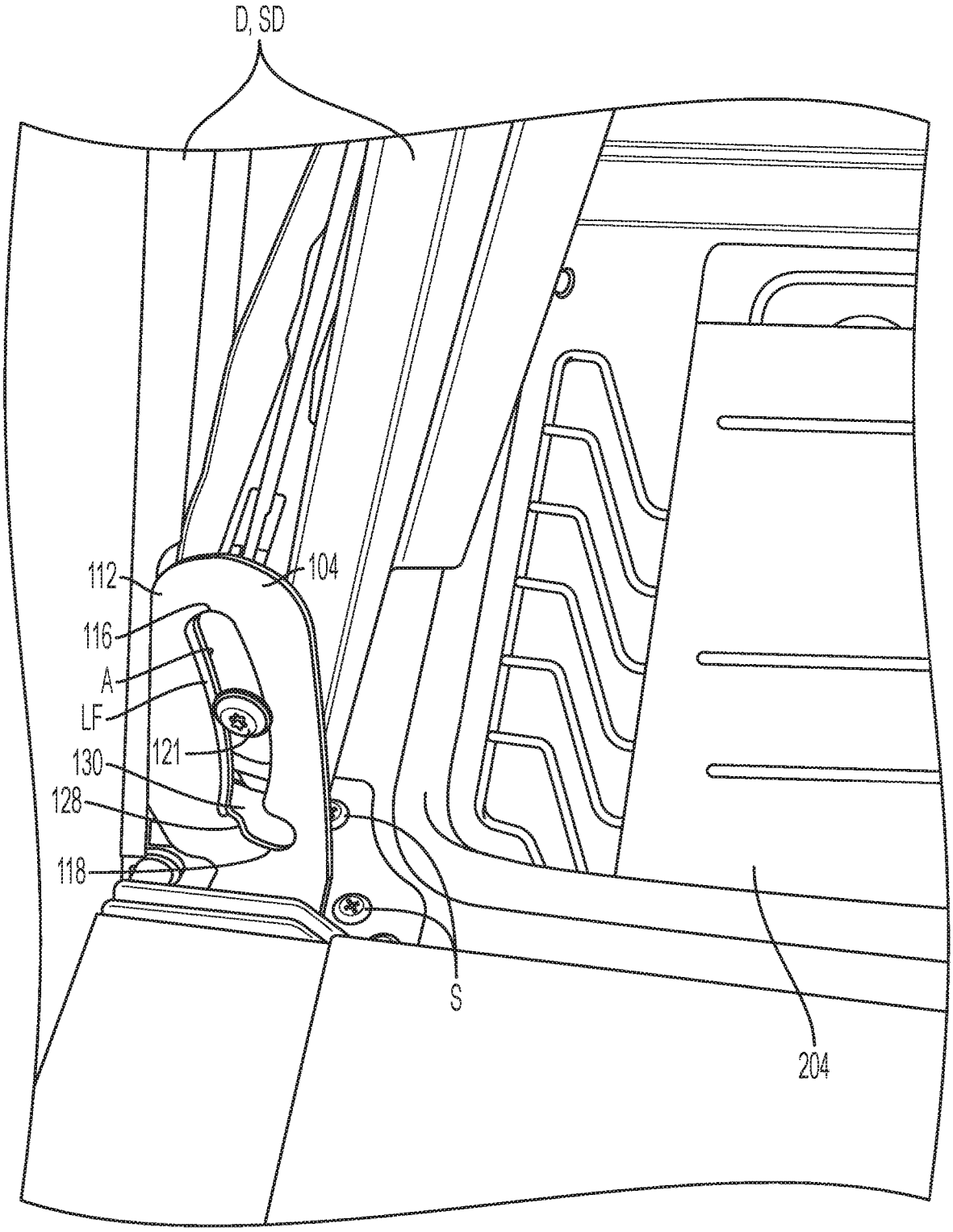
FIG. 4 is a perspective view from below of the door keeper installed on the side-opening oven door of a built-in oven with the side-opening oven door in a partially open position according to an exemplary embodiment consistent with present disclosure.

With reference to FIGS. 1, 2, and 4, the door keeper 100 also includes a keeper member 120 movably disposed in the keeper guide slot 114 and fixedly attached to the bottom portion of the door D (such as a door frame bottom portion of the door D) via a suitable fastener such as a screw 121 (e.g., a thread-forming screw M5). The keeper member 120 comprises a flanged keeper bearing roller 120' which defines a roller groove G which is configured to permit the keeper plate 104 to glide in the roller groove G during the opening motion of the door D. The flanged keeper bearing roller 120' comprises an upper flange 124 that is configured to slide over an upper face UF of the keeper plate 104 and a lower flange 125 that is configured to slide over a lower face LF of the keeper plate 104, and a roller bearing body 126 that extends between the upper flange 124 and the lower flange 125 to define the roller groove G and is configured to glide with respect to the keeper guide slot 114. The upper and lower flanges 124 and 125 and the roller bearing body 126 may be formed of, for example, lubricated SAE 841 bronze.

With reference to FIGS. 1, 2, and 4, the opposite slot end portion 118 of the keeper guide slot 114 comprises an insertion portion 128 at a bearing insertion position P2 having an opening slightly larger than a diameter of the upper and lower flanges 124 and 125 in order to permit the flanged keeper bearing roller 120' to be inserted and removed from the keeper guide slot 114 during assembly or servicing. Note that FIGS. 1 and 2 also show the flanged keeper bearing roller 120' in the bearing insertion position P2 such that the flanged keeper bearing roller 120' is removed from the keeper guide slot 114. The insertion portion 128 extends at an angle like a dog leg from a remaining portion 130 of the keeper guide slot 114, where the remaining portion 130 has a width similar to a diameter of the roller bearing body 126 to permit a gliding movement of the flanged keeper bearing roller 120' in the keeper guide slot 114. The insertion portion 128 is separated from the remaining portion 130 by a necked portion 132 (see FIG. 4). The remaining portion 130 of the keeper guide slot 114 comprises an arcuate portion A which extends from the door side slot end portion 116 to a bearing closed door position P3 which is adjacent to the opposite slot end portion 118 (see FIGS. 2 and 6).

In operation, an opening motion of the door D stops when the door side slot end portion 116 of the keeper guide slot 114 engages the keeper member 120 as best shown in FIG. 5. In addition, in the case where the door D is a side-opening oven door SD, the side-opening oven door SD is pivotally mounted by at least one hinge H on at least one hinge shaft 140 (see FIG. 3). With reference to FIG. 3, the at least one hinge H and the at least one hinge shaft 140 comprises lower and upper hinges and two hinge shaft portions, a lower hinge shaft portion 140A and an upper hinge shaft portion (not shown), with only the lower hinge H and the lower hinge shaft portion 140A being visible in FIG. 3. The lower hinge shaft portion 140A is mounted on an extension 142 of the horizontal portion 102B of the hinge bracket 102. The upper hinge shaft portion (not shown) is mounted on the upper hinge (not shown). Alternatively, a single elongated hinge shaft 140 which extends from the hinge bracket 102 to the upper hinge (not shown) may be used. As best shown in FIGS. 3 and 5, the predetermined angle of the door opening angle is 130°±5°. Accordingly, on condition that the door side slot end portion 116 of the keeper guide slot 114 engages the keeper member 120, the keeper plate 104 contacts the at least one hinge shaft 140, 140A at a slight cutaway portion 144 as best shown in FIGS. 2 and 3.

FIG. 6 shows a lower corner portion of a built-in oven OB as the support structure O having the side-opening oven door SD. The built-in oven OB comprises an oven body 200 defining an oven cavity 202 having an opening 204 (see FIGS. 3 and 4) that is closable by the side-opening oven door SD, the side-opening oven door SD being pivotally mounted to the oven body 200 on the at least one hinge shaft 140. In FIG. 6, the door keeper 100 for keeping an opening angle of the side-opening oven door SD within a predetermined angle is shown in the bearing closed door position P3 (see FIG. 2) where the side-opening oven door SD is fully closed. As is visible in FIGS. 4 and 5, the side-opening oven door SD may be formed in two pieces, an inner door liner and an outer door skin/glass assembly (unnumbered).

The present invention has substantial opportunity for variation without departing from the spirit or scope of the present invention. For example, while the door keeper of the present disclosure has been described and shown in connection with a side-opening oven door for a built-in oven, the door keeper clearly has applications with respect to doors of other home appliances such as but not limited to microwave ovens, washing machines, dryers, and the like, as well as doors for kitchen cupboards, and doors in general where preventing a door from over-travelling and accidentally colliding with a wall, a piece of furniture, and the like is desired. Moreover, while the drawings show a left side hinge door for opening on the right hand side (e.g., if a handle is used it would be on the right hand side), the present disclosure is equally applicable to a right side hinge door for opening on the left hand side (e.g., if a handle is used it would be on the left hand side).

Those skilled in the art will recognize improvements and modifications to the exemplary embodiments of the present invention. All such improvements and modifications are considered within the scope of the concepts disclosed herein and the claims that follow.

What is claimed is:

1. A door keeper for keeping a door opening angle of a door within a predetermined angle, the door keeper comprising:

a hinge bracket configured to be attached to a support structure, the hinge bracket having a vertical portion and a horizontal portion, the vertical portion having a wrap-around portion that wraps around a portion of the support structure;

a keeper plate having a bracket side end portion pivotally mounted to the horizontal portion of the hinge bracket, a door side end portion, and a keeper guide slot having a door side slot end portion disposed at a location proximate to the door side end portion of the keeper plate, the keeper guide slot extending from the door side slot end portion to an opposite slot end portion disposed at a location between the bracket side end portion and the door side end portion of the keeper plate; and a keeper member movably disposed in the keeper guide slot and fixedly attached to a lower part of the door, wherein on condition that the door side slot end portion of the keeper guide slot engages the keeper member, an opening motion of the door stops.

2. The door keeper of claim 1, wherein the keeper member comprises a flanged keeper bearing roller which defines a roller groove which is configured to permit the keeper plate to glide in the roller groove during the opening motion of the door.

3. The door keeper of claim 2, wherein the flanged keeper bearing roller comprises an upper flange that is configured to slide over an upper face of the keeper plate and a lower flange that is configured to slide over a lower face of the keeper plate, and a roller bearing body that extends between the upper flange and the lower flange to define the roller groove and is configured to glide with respect to the keeper guide slot.

4. The door keeper of claim 3, wherein the opposite slot end portion of the keeper guide slot comprises an insertion portion having an opening slightly larger than a diameter of the upper and lower flanges in order to permit the flanged keeper bearing roller to be inserted and removed from the keeper guide slot during assembly or servicing.

5. The door keeper of claim 4, wherein the insertion portion extends at an angle from a remaining portion of the keeper guide slot, where the remaining portion has a width similar to a diameter of the roller bearing body to permit a gliding movement of the flanged keeper bearing roller in the keeper guide slot.

6. The door keeper of claim 1, wherein the bracket side end portion of the keeper plate is pivotally mounted to the hinge bracket via a rivet.

7. The door keeper of claim 1, wherein the keeper member is fixedly attached to a bottom portion of the door.

8. The door keeper of claim 7, wherein the keeper member is fixedly attached to the bottom portion of the door via a screw.

9. The door keeper of claim 1, wherein the keeper guide slot comprises an arcuate portion which extends from the door side slot end portion to a bearing closed door position which is adjacent to the opposite slot end portion.

10. The door keeper of claim 9, wherein the door side slot end portion corresponds to a bearing open door position.

11. The door keeper of claim 9, wherein the opposite slot end portion of the keeper guide slot comprises an insertion portion configured to permit the keeper member to be inserted and removed from the keeper guide slot during assembly or servicing.

12. The door keeper of claim 1, wherein the predetermined angle of the door opening angle is 130°±5°.

13. The door keeper of claim 1, wherein keeper guide slot that is shaped so as to permit the keeper plate to glide in a roller groove of the keeper member and such that the keeper guide slot is completely concealed in a working range of 0° to 130°±5°.

* * * * *